US005938893A

United States Patent [19]

Trokhan et al.

[11] Patent Number: 5,938,893

[45] **Date of Patent: *Aug. 17, 1999**

[54] FIBROUS STRUCTURE AND PROCESS FOR MAKING SAME

[75] Inventors: Paul Dennis Trokhan, Hamilton; Mark Ryan Richards, Middletown; Michael Gomer Stelljes, Jr., West Chester, all of Ohio

[73] Assignee: The Procter & Gamble Company, Cincinnati, Ohio

[ * ] Notice: This patent is subject to a terminal disclaimer.

[21] Appl. No.: 08/920,204

[22] Filed: Aug. 15, 1997

[51] Int. Cl.[6] ..... D21H 11/00

[52] U.S. Cl. ..... 162/109; 162/205; 162/207; 162/111; 162/117; 34/414; 34/422

[58] Field of Search ..... 162/203, 204, 162/205, 206, 207, 111, 109, 117, 113; 428/152, 153; 34/414, 419, 421, 422

[56] References Cited

U.S. PATENT DOCUMENTS

| | | | |
|---|---|---|---|
| 3,812,000 | 5/1974 | Salvucci, Jr. et al. | 162/111 |
| 3,821,068 | 6/1974 | Shaw | 162/111 |
| 4,112,586 | 9/1978 | Lehtinen | 34/9 |
| 4,347,100 | 8/1982 | Brucato | 162/10 |
| 4,506,456 | 3/1985 | Lehtinen | 34/12 |
| 4,506,457 | 3/1985 | Lehtinen | 34/41 |
| 4,507,173 | 3/1985 | Klowak et al. | 162/112 |
| 4,514,345 | 4/1985 | Johnson et al. | 264/22 |
| 4,528,239 | 7/1985 | Trokhan | 428/247 |
| 4,529,480 | 7/1985 | Trokhan | 162/109 |
| 4,622,758 | 11/1986 | Lehtinen et al. | 34/13 |
| 4,637,859 | 1/1987 | Trokhan | 162/109 |
| 4,899,461 | 2/1990 | Lehtinen | 34/13 |
| 4,932,139 | 6/1990 | Lehtinen | 34/41 |
| 4,958,444 | 9/1990 | Rautakorpi et al. | 34/71 |
| 5,277,761 | 1/1994 | Phan | 162/109 |
| 5,334,289 | 8/1994 | Trokhan et al. | 162/358.2 |
| 5,580,423 | 12/1996 | Ampulski | 162/111 |
| 5,594,997 | 1/1997 | Lehtinen | 34/95 |
| 5,709,774 | 1/1998 | Naieni | 162/9 |
| 5,795,440 | 8/1998 | Ampulski et al. | 162/117 |

FOREIGN PATENT DOCUMENTS

| | | |
|---|---|---|
| 0 745 717 A1 | 12/1996 | European Pat. Off. . |
| WO 98/00604 | 1/1998 | WIPO . |

OTHER PUBLICATIONS

The effect of Condebelt drying on the structure of fiber bonds. L. Kunnas et al., vol. 76, No. 4, Tappi Journal, pp. 95–104.

*Primary Examiner*—Jose Fortuna
*Attorney, Agent, or Firm*—Vladimir Vitenberg; Larry L. Huston; E. Kelly Linman

[57] ABSTRACT

A differential micro-regions single lamina fibrous web comprises at least two pluralities of micro-regions disposed in a non-random and repeating pattern: a first plurality of micro-regions comprising fibers interconnected with a fiber-bonding substance, and a second plurality of micro-regions, preferably not interconnected with the fiber-binding substance. The fiber-binding substance is selected from the group consisting of hemicelluloses, lignin, polymeric extractives, and any combination thereof. The fibers of the first plurality of micro-regions are bonded together by a process of softening, flowing, and immobilization of the fiber-binding substance between the cellulosic fibers. The process for making the fibrous web comprises the steps of heating the web containing the fiber-binding substance to a temperature sufficient to cause the fiber-bonding substance to soften; pressurizing the fibrous web thereby causing the fiber-binding substance to flow and interconnect those fibers which are mutually juxtaposed in the first plurality of micro-regions; and then immobilizing the fiber-binding substance thereby creating fiber-bonds between the fibers which are interconnected in the first plurality of micro-regions.

17 Claims, 7 Drawing Sheets

FIBROUS STRUCTURE AND PROCESS FOR MAKING SAME

FIELD OF THE INVENTION

The present invention is related to processes for making strong, soft, absorbent fibrous webs. More particularly, the present invention is concerned with fibrous webs having micro-regions formed by fibers interconnected by a fiber-binding substance.

BACKGROUND OF THE INVENTION

Fibrous products are used for a variety of purposes. Paper towels, facial tissues, toilet tissues, and the like are in constant use in modem industrialized societies. The large demand for such fibrous products, including paper products, has created a demand for improved versions of the products. If the paper products such as paper towels, facial tissues, toilet tissues, and the like are to perform their intended tasks and to find wide acceptance, they must possess certain physical characteristics. Among the more important of these characteristics are strength, softness, and absorbency.

Strength is the ability of a fibrous web to retain its physical integrity during use.

Softness is the pleasing tactile sensation consumers perceive when they use the fibrous product for its intended purposes.

Absorbency is the characteristic of the fibrous product that allows the product to take up and retain fluids, particularly water and aqueous solutions and suspensions. Important not only is the absolute quantity of fluid a given amount of the product will hold, but also the rate at which the product will absorb the fluid.

Fibrous structures currently made by the present assignee contain multiple micro-regions defined by differences in density and/or basis weight. The more typical differential density cellulosic structures are created by first, an application of vacuum pressure to the wet web associated with a molding belt thereby deflecting a portion of the papermaking fibers—to generate the low density regions, and second, pressing portions of the web comprising the non-deflected papermaking fibers against a hard surface, such as a surface of a Yankee dryer drum,—to produce the high density regions. High density micro-regions of such cellulosic structures generate strength, while low density micro-regions contribute softness, bulk and absorbency.

Such differential density cellulosic structures may be produced using through-air drying papermaking belts comprising a reinforcing structure and a resinous framework, which belts are described in commonly assigned U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,334,289 issued to Trokhan et al on Aug. 2, 1994. The foregoing patents are incorporated herein by reference.

There is a well-established relationship between strength and density of a fibrous web. Therefore, the efforts have been made to produce highly densified fibrous webs. One of such methods, known as CONDEBELT® technology, is disclosed in the U.S. Pat. No. 4,112,586 issued Sep. 12, 1978; the U.S. Pat. Nos. 4,506,456 and 4,506,457 both issued Mar. 26, 1985; U.S. Pat. No. 4,899,461 issued Feb. 13, 1990; U.S. Pat. No. 4,932,139 issued Jun. 12, 1990; U.S. Pat. No. 5,594,997 issued Jan. 21, 1997, all foregoing patents issued to Lehtinen; and U.S. Pat. No. 4,622,758 issued Nov. 18, 1986 to Lehtinen et al.; U.S. Pat. No. 4,958,444 issued Sep. 25, 1990 to Rautakorpi et al. All the foregoing patents are assigned to Valmet Corporation of Finland and incorporated by reference herein. The CONDEBELT® technology uses a pair of moving endless bands to dry the web which is pressed and moves between and in parallel with the bands. The bands have different temperatures. A thermal gradient drives water from the relatively heated side, and the water condenses into a fabric on the relatively cold side. A combination of temperature, pressure, moisture content of the web, and residence time causes the hemicelluloses and lignin contained in the papermaking fibers of the web to soften and flow, thereby interconnecting and "welding" the papermaking fibers together.

While the CONDEBELT® technology allows production of a highly-densified strong paper suitable for packaging needs, this method is not adequate to produce a strong and—at the same time—soft fibrous products such as facial tissue, paper towel, napkins, toilet tissue, and the like.

Therefore, it is a purpose of the present invention to provide a novel process for making a strong, soft, and absorbent fibrous structures comprising at least two micro-regions: micro-regions formed by the fibers which are interconnected by the fiber-binding substance, and micro-regions which are not interconnected by the fiber-binding substance. It is still another object of the present invention to provide a fibrous structure having a plurality of micro-regions comprising fibers interconnected by the fiber-binding substance.

It is another object of the present invention to provide an apparatus for making such a fibrous web.

SUMMARY OF THE INVENTION

A single lamina fibrous web comprises at least two pluralities of micro-regions preferably disposed in a non-random and repeating pattern: a first plurality of micro-regions and a second plurality of micro-regions. The first plurality of micro-regions comprises fibers which are interconnected with a fiber-binding substance in the first plurality of micro-regions. The second plurality of micro-regions comprises fibers which are not interconnected with a fiber-binding substance in the second plurality of micro-regions. The fiber-binding substance is preferably selected from the group consisting of hemicelluloses, lignin, extractives, and any combination thereof. The fiber-binding substance may be inherently contained in the fibers. Alternatively or additionally, the fiber-binding substance may be added to the fibers or the fibrous web as part of a process for making the web of the present invention. The fibers in the first plurality of micro-regions are fiber-bonded, i. e., bonded together by a process of softening, flowing, and then immobilization of the fiber-binding substance in the web's selected portions comprising the first plurality of micro-regions.

In one preferred embodiment, the first plurality of micro-regions comprises an essentially continuous, macroscopically monoplanar and patterned network area; and the second plurality of micro-regions comprises a plurality of discrete domes dispersed throughout, encompassed by, and isolated one from another by the network area. The second plurality of micro-regions may comprises an essentially continuous and patterned network area; and the first plurality of micro-regions may comprise a plurality of discrete knuckles circumscribed by and dispersed throughout the network area.

In the process aspect of the present invention, the process for making a single lamina fibrous web comprises the following steps:

providing a fibrous web comprising a fiber-binding substance and water;

providing a macroscopically monoplanar belt having a web-side surface and a backside surface opposite the web-side surface;

depositing the fibrous web on the belt;

heating at least selected portions of the web for a period of time and to a temperature sufficient to cause the fiber-binding substance contained in the selected portions of the web to soften;

applying pressure to at least the selected portions of the web, thereby causing the fiber-binding substance in the selected portions to flow and interconnect those cellulosic fibers which are mutually juxtaposed in the selected portions;

immobilizing the fiber-binding substance thereby creating fiber-bonds between the fibers which are interconnected in the selected portions, thus forming the first plurality of micro-regions from the selected portions of the web.

The step of immobilizing the fiber-binding substance may be accomplished by either one or combination of the following: drying at least the selected portions of the web; cooling at least the selected portions of the web; releasing the selected portions of the web from the pressure.

The step of applying the pressure may be accomplished by pressurizing the web in association with the papermaking belt between a mutually opposed first press member and a second press member, the first and second press members being pressed toward each other. The first press member has a first press surface; and the second press member has a second press surface. The press surfaces are parallel to each other and mutually opposed. The web and the papermaking belt are interposed between the first and second press surfaces such that the first press surface contacts the web, and the second press surface contacts the backside surface of the papermaking belt. The first press surface preferably comprises an essentially continuous network area.

The process may include the step of depositing the fiber-binding substance in/on at least the selected portions of the web, or in/on the fibers from which the web is formed.

In case a fluid-permeable belt having deflection conduits is utilized in the process of the present invention, the process may further comprise the step of applying a fluid pressure differential to the web such as to leave a first portion of the web on the web-side surface of the belt while deflecting a second portion of the web into the deflection conduits. In the latter case, the web-side surface of the belt preferably comprises an essentially continuous web-side network which defines web-side openings of the deflection conduits.

DETAILED DESCRIPTION OF THE INVENTION

Figure 1:
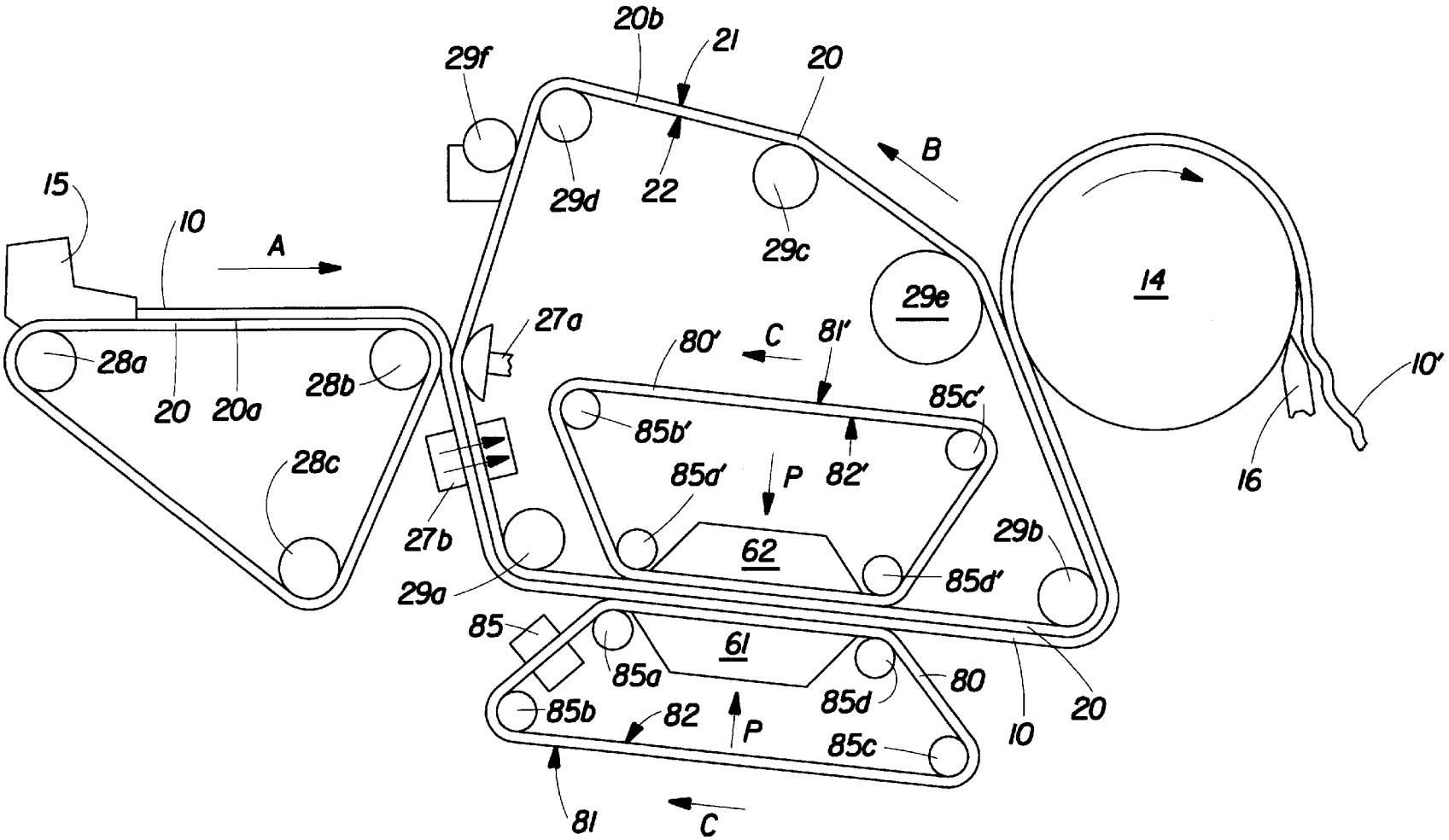
FIG. 1 is a schematic side elevational view of one exemplary embodiment of a continuous papermaking process of the present invention, showing a web being heated by a heating wire and pressurized between a pair of press members.
Figure 1A:
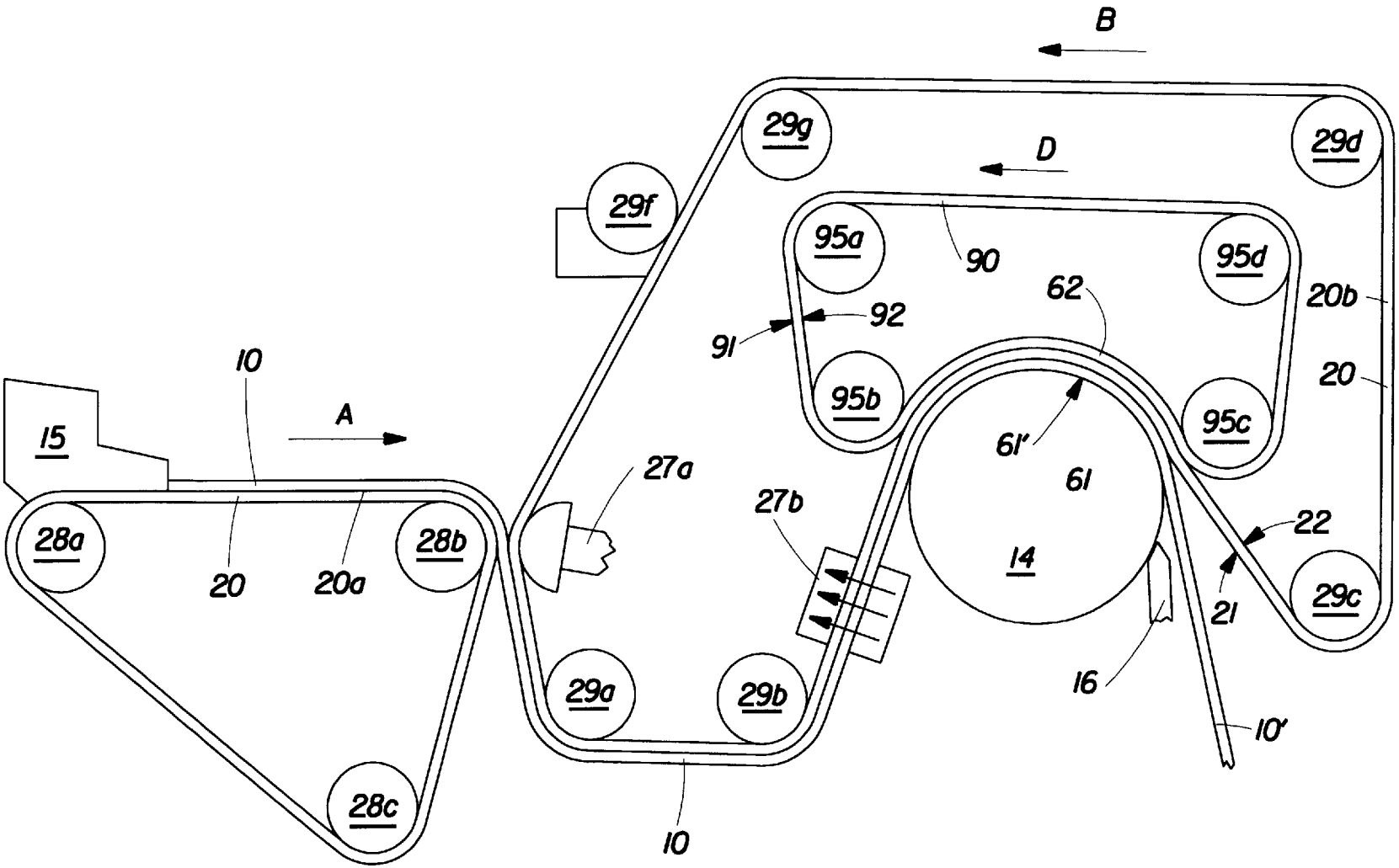
FIG. 1A is a schematic side elevational view of another exemplary embodiment of a continuous papermaking process of the present invention, showing a web being heated by a Yankee drying drum and pressurized between the Yankee drying drum and a pressing belt.

The papermaking process of the present invention comprises a number of steps or operations which occur in the general time sequence as noted below. It is to be understood, however, that the steps described below are intended to assist a reader in understanding the process of the present invention, and that the invention is not limited to processes with only a certain number or arrangement of steps. In this regard, it is noted that it is possible, and in some cases even preferable, to combine at least some of the following steps so that they are performed concurrently. Likewise, it is possible to separate at least some of the following steps into two or more steps without departing from the scope of this invention. FIGS. 1 and 1A are simplified, schematic representations of two embodiments of a continuous papermaking process of the present invention.

The first step of the process of the present invention is providing a fibrous web 10 comprising a fiber-binding substance. As used herein, the term "fibrous web" includes any web comprising cellulosic fibers, synthetic fibers, or any combination thereof. The fibrous web 10 may be made by any papermaking process known in the art, including, but not limited to, a conventional process and a through-air drying process. As used herein, the fibrous web designated by the reference numeral 10 is the web which is subjected to the process of the present invention; and the fibrous web designated by the reference numeral 10* is a finished product made by the process of the present invention. As used herein, any and all fibers comprising the fibrous web 10 and the fibrous web 10* are designated by the reference numeral 100. Suitable fibers 100 may include recycled, or secondary, papermaking fibers, as well as virgin papermaking fibers. Such fibers may comprise hardwood fibers, softwood fibers, and non-wood fibers.

Figure 2:
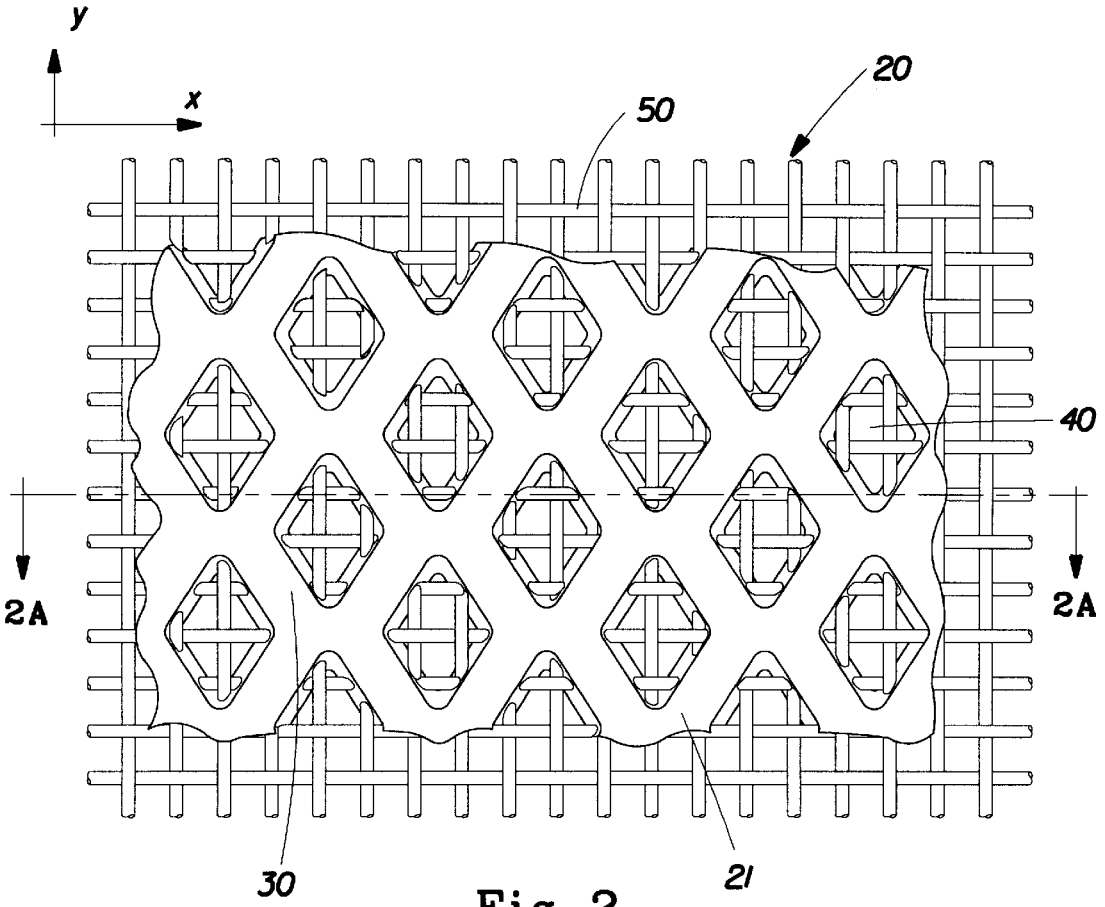
FIG. 2 is a schematic top plan view of a papermaking belt utilized in the process of the present invention, having an essentially continuous web-side network and discrete deflection conduits.

The step of providing a fibrous web 10 may be preceded by the steps of forming such a fibrous web 10. One skilled in the art will readily recognize that forming the fibrous web 10 may include the steps of providing a plurality of fibers 100. In a typical process, the plurality of the fibers 100 are preferably suspended in a fluid carrier. More preferably, the plurality of the fibers 100 comprises an aqueous dispersion of the fibers 100. The equipment for preparing the aqueous dispersion of the fibers 100 is well-known in the art and is therefore not shown in FIGS. 1 and 2. The aqueous dispersion of the fibers 100 may be provided to a headbox 15. A single headbox is shown in FIGS. 1 and 2. However, it is to be understood that there may be multiple headboxes in alternative arrangements of the process of the present invention. The headbox(es) and the equipment for preparing the aqueous dispersion of fibers are typically of the type disclosed in U.S. Pat. No. 3,994,771, issued to Morgan and Rich on Nov. 30, 1976, which is incorporated by reference herein. The preparation of the aqueous dispersion of the papermaking fibers and the characteristics of such an aqueous dispersion are described in greater detail in U.S. Pat. No. 4,529,480 issued to Trokhan on Jul. 16, 1985, which is incorporated herein by reference.

According to the present invention, the fibrous web 10 comprises a fiber-binding substance. As used herein, the term "fiber-binding substance" designates a matter capable of interconnecting the fibers 100 of the web 10 under certain conditions of moisture temperature pressure and time, as to create fiber-bonds therebetween. Selected portions of the web 10, in which the fibers 100 are interconnected with the fiber-binding substance, will form a first plurality of distinct micro-regions of the web 10*, different from the rest of the web 10* in that the rest of the web 10* will comprise the fibers 100 which are not interconnected with the fiber-binding substance. The preferred fiber-binding substance of the present invention is selected from the group comprising lignin, hemicelluloses, extractives, and any combination thereof. Other types of the fiber-binding substance may also be utilized if desired. European Patent Application EP 0 616 074 A1 discloses a paper sheet formed by a wet pressing process and adding a wet strength resin to the papermaking fibers.

As well known in the papermaking art, typically, wood used in papermaking inherently comprises cellulose (about 45%), hemicelluloses (about 25–35%), lignin (about 21–25%) and extractives (about 2–8%). G. A. Smook, *Handbook for Pulp & Paper Technologists, TAPPI,* 4th printing, 1987, pages 6–7, which book is incorporated by reference herein. Hemicelluloses are polymers of hexoses (glucose, mannose, and galactose) and pentoses (xylose and arabinose). Id., at 5. Lignin is an amorphous, highly polymerized substance which comprises an outer layer of a fiber. Id., at 6. Extractives are a variety of diverse substances present in native fibers, such as resin acids, fatty acids, turpenoid compounds, and alcohols. Id. Hemicelluloses, lignin, and extractives are typically a part of cellulosic fibers, but may be added independently to a plurality of papermaking cellulosic fibers, or web, if desired, as part of a web-making process.

As a result of mechanical and/or chemical treatment of wood to produce pulp, portions of hemicelluloses, lignin, and extractives are removed from the papermaking fibers. It is believed that when the fibers are brought together during a papermaking process, cellulose hydroxyl groups are linked together by hydrogen bonds. Smook, infra, at 8. Therefore, the removal of most of the lignin, while retaining substantial amounts of hemicelluloses, is generally viewed as a desirable occurrence, because the removal of lignin increases ability of fibers 100 to form inter-fiber bonds as well as increases absorbency of the resulting web. A process of "beating" or "refining" which causes removal of primary fiber walls also helps to increase fiber absorbency (Id., at 7), as well as increase fibers' flexibility. Although some portion of the fiber-binding substance inherently contained in the pulp is removed from the papermaking fibers during mechanical and/or chemical treatment of the wood, the papermaking fibers still retain a portion of the fiber-binding substance even after the chemical treatment. The claimed invention allows advantageous use of the fiber-binding substance which is inherently contained in the wood pulp and which has traditionally been viewed as undesirable in the papermaking process.

Alternatively or additionally, the fiber-binding substance may be supplied independently of the fibers 100 and added to the web 10, or to the fibers 100 before the web 10 has been formed, during the papermaking process of the present invention. Independent deposition of the fiber-binding substance in/on the web 10 or in/on the fibers 100 may be preferred, and even necessary, in the process of making the web 10 comprising the fibers 100 which do not inherently contain a sufficient amount of the fiber-binding substance, or which do not inherently contain the fiber-binding substance at all, such as, for example, synthetic fibers. The fiber-binding substance may be deposited in/on the web 10 or the fibers 100 in the form of substantially pure chemical compounds. Alternatively, the fiber-binding substance may be deposited in the form of cellulosic fibers containing the fiber-binding substance.

The next step is providing a macroscopically monoplanar web-making belt 20. As used herein, the term "web-making belt 20," or simply, "belt 20," is a generic term including both a forming belt 20*a* and a molding belt 20*b*, both belts shown in the preferred form of an endless belt in FIGS. 1 and 2. The present invention may utilize the single belt 20 functioning as both the forming belt 20*a* and the molding belt 20*b* (this embodiment is not shown in the figures of the present invention but may easily be visualized by one skilled in the art). However, the use of the separate belts 20*a* and 20*b* is preferred. One skilled in the art will understand that the present invention may utilize more than two belts; for example, a drying belt (not shown), separate from the forming belt 20*a* and the molding belt 20*b*, may be used. As schematically shown in FIGS. 1–3A and 5, the belt 20 has a web-side surface 21 defining an X-Y plane, a backside 22 surface opposite to the web-side surface, and a Z-direction perpendicular to the X-Y plane.

The belt 20 may be made according to the following commonly assigned and incorporated herein U.S. Pat. Nos.: 4,514,345 issued to Johnson et al. on Apr. 30, 1985; 4,528,239 issued to Trokhan on Jul. 9, 1985; 4,529,480 issued to Trokhan on Jul. 16, 1985; 4,637,859 issued to Trokhan on Jan. 20, 1987; 5,334,289 issued to Trokhan et al. on Aug. 2, 1994; 5,628,876 issued to Ayers et al. on May, 13, 1997.

Figure 5:
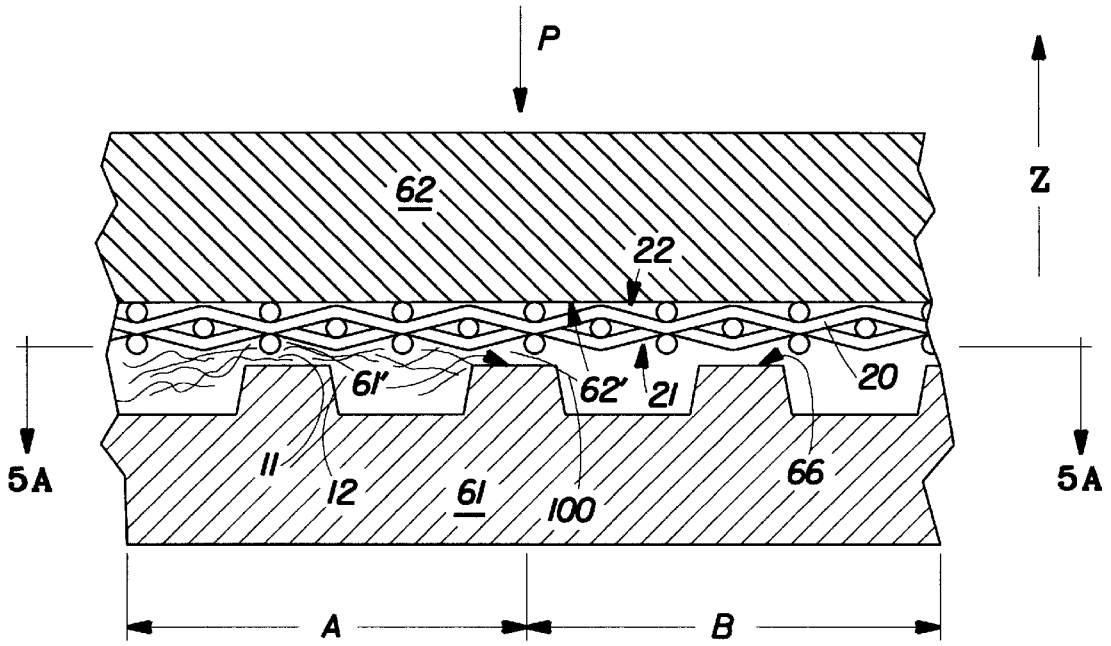
FIG. 5 is a schematic fragmentary cross-sectional view of the papermaking belt having a fibrous web thereon, the web and the belt being pressurized between a first press member and a second press member.

One embodiment of the belt 20 is schematically shown in FIG. 5. The commonly assigned U.S. Pat. No. 4,239,065 issued Dec. 16, 1980 in the name of Trokhan and incorporated by reference herein, discloses this type of the belt 20 that can be utilized in the present invention. The foregoing belt 20 has no resinous framework, and the web-side surface 21 of the foregoing belt 20 is defined by co-planar crossovers distributed in a predetermined pattern throughout the belt 20. Another type of the belt which can be utilized as the belt 20 in the process of the present invention is disclosed in the European Patent Application having Publication Number: 0 677 612 A2, filed Dec. 4, 1995.

While in the present invention a woven element is preferred for the reinforcing structure 25 of the belt 20, the belt 20 can be made using a felt as a reinforcing structure, as set forth in U.S. Pat. No. 5,556,509 issued Sep. 17, 1996 to Trokhan et al. and the patent applications: Ser. No. 08/391,372 filed Feb. 15, 1995 in the name of Trokhan et al. and entitled: "Method of Applying a Curable Resin to a Substrate for Use in Papermaking"; Ser. No. 08/461,832 filed Jun. 5, 1995 in the name of Trokhan et al. and entitled: "Web Patterning Apparatus Comprising a Felt Layer and a Photosensitive Resin Layer." These patent and applications are assigned to The Procter & Gamble Company and are incorporated herein by reference.

Figure 1B:
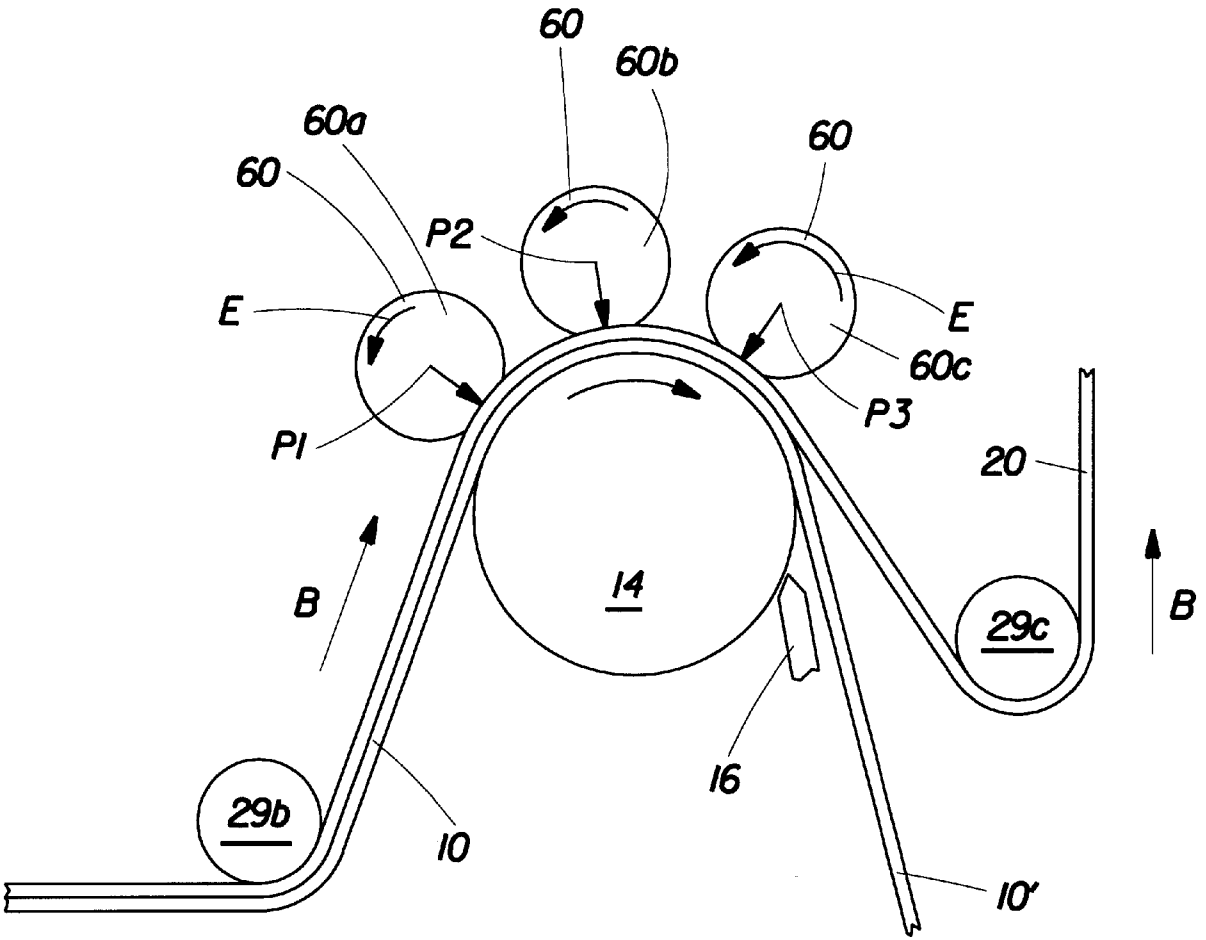
FIG. 1B is a schematic fragmental side elevational view of the process of the present invention, showing a web being pressurized between a Yankee drying drum and pressing rolls.

In the embodiments illustrated in FIGS. 1, 1A and 1B, the molding belt 20*b* travels in the direction indicated by the directional arrow B. In FIG. 1, the molding belt 20*b* passes around return rolls 29*c*, 29*d*, an impression nip roll 29*e*, return rolls 29*a*, and 29*b*. In FIG. 1A, the molding belt 20*b* passes around return rolls 29*a*, 29*b*, 29*c*, 29*d*, and 29*g*. In both FIGS. 1 and 1A, an emulsion-distributing roll 29*f* distributes an emulsion onto the molding belt 20*b* from an emulsion bath. If desired, the loop around which the molding belt 20*b* travels may also includes a means for applying a fluid pressure differential to the web 10, such as, for example, a vacuum pick-up shoe 27*a* and/or a vacuum box 27*b*. The loop may also include a pre-dryer (not shown). In addition, water showers (not shown) are preferably utilized in the papermaking process of the present invention to clean the molding belt 20*b* of any paper fibers, adhesives, and the like, which may remain attached to the molding belt 20*b* after it has traveled through the final step of the process. Associated with the molding belt 20*b*, and also not shown in FIGS. 1 and 1A, are various additional support rolls, return rolls, cleaning means, drive means, and the like commonly used in papermaking machines and all well known to those skilled in the art.

The next step is depositing the fibrous web 10 on the web-side surface 21 of the belt 20. If the web 10 is transferred from the forming belt 20*a* to the molding belt 20*b*, conventional equipment, such as vacuum pick-up shoe 27*a* (FIGS. 1 and 1A), may be utilized to accomplish the transferal. As has been pointed out above, in at least one embodiment of the process of the present invention, the single belt 20 may be utilized as both the forming belt 20*a* and the molding belt 20*b*. In the latter case, the step of transferal is not applicable, as one skilled in the art will readily appreciate. Also, one skilled in the art will understand that the vacuum pick-up shoe 27*a* shown in FIGS. 1 and 1A is the one preferred means of transferring the web 10 from the forming belt 20*a* to the molding belt 20*b*. Other equipment, such as intermediate belt or the like (not shown) may be utilized for the purpose of transferring the web 10 from the forming belt 20*a* to the molding belt 20*b*. The commonly assigned U.S. Pat. No. 4,440,579 issued Apr. 3, 1984 to Wells et al. is incorporated by reference herein.

The next step in the process of the present invention comprises heating the fibrous web 10, or at least selected portions 11 of the web 10. It is believed that heating the web 10 to a sufficient temperature and for a sufficient period of time will cause the fiber-binding substance contained in the web 10 to soften. Then, under pressure applied to the selected portions 11 of the web 10 contained the fiber-binding substance, the softened fiber-binding substance becomes flowable and capable of interconnecting those papermaking fibers 100 which are mutually juxtaposed in the selected portions 11.

The step of heating the web 10 can be accomplished by a variety of means known in the art. For example, as schematically shown in FIG. 1, the web 10 may be heated by a heating wire 80. The heating wire 80 travels around return rolls 85*a*, 85*b*, 85*c*, and 85*d* in the direction indicated by the directional arrow C. The heating wire 80 is in contact with the web 10. The heating wire 80 is heated by a heating apparatus 85. Such principal arrangement is disclosed in U.S. Pat. No. 5,594,997 issued to Jukka Lehtinen on Jan. 21, 1997 and assigned to Valmet Corporation (of Finland). Alternatively or additionally, the web 10 can be heated by steam, as disclosed in U.S. Pat. No. 5,506,456 issued to Jukka Lehtinen on Mar. 26, 1985 and assigned to Valmet Corporation (of Finland). Both foregoing patents are incorporated by reference herein.

Figure 5A:
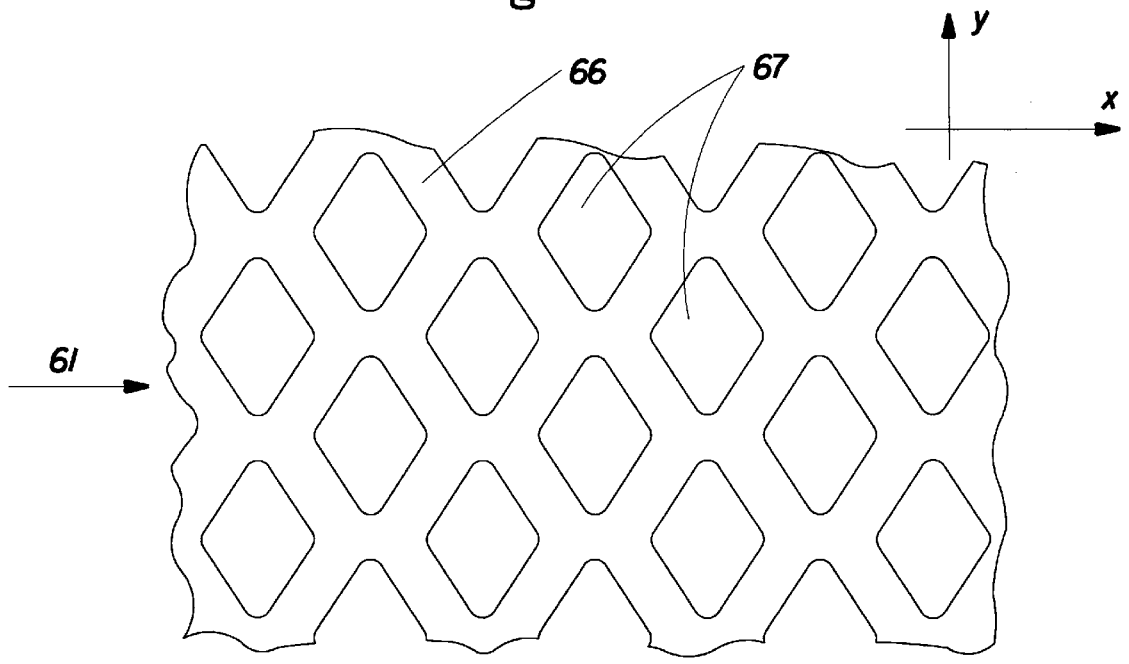
FIG. 5A is a schematic plan view of the first press member, taken along lines 5A—5A of FIG. 5 and showing one embodiment of the first press surface comprising an essentially continuous network area.

The heating wire 80 may comprise a first pressing surface 61* shown in FIGS. 5 and 5A, as will be explained in greater detail below. The first press surface 61* shown in FIGS. 5 and 5A comprises an essentially continuous network area 66 defining discrete depressions 67 in the first press surface 61*. Then, the selected portions of the web 10 comprise the portions of the web 10 corresponding to the network area 66 in Z-direction. One skilled in the art will readily understand that the first press surface 61* comprising an essentially continuous network area 66 shown in FIG. 5A is one embodiment of the first press surface 61*, and other patterns of the first press surface 61* may be utilized or even preferred.

The application of temperature to the web 10 may be zoned (not shown). For example, as the web 10 in association with the belt 20 passes between pressing members 61 and 62 (which are defined herein below) as shown in FIG. 5, in a first zone A the web 10 is fast-heated to a temperature T sufficient to cause the fiber-binding substance contained in the selected portions 11 of the web 10 to soften and flow; and in a second zone B the web 10 is merely maintained at the temperature T. Such "zoned" application of temperature allows one to better control the time during which the fiber-binding substance is in a softened and flowable condition, and may provide energy-related savings. PCT Application WO 97/19223 shows one of the possible principal arrangements suitable for the process of the present invention.

Figure 2A:
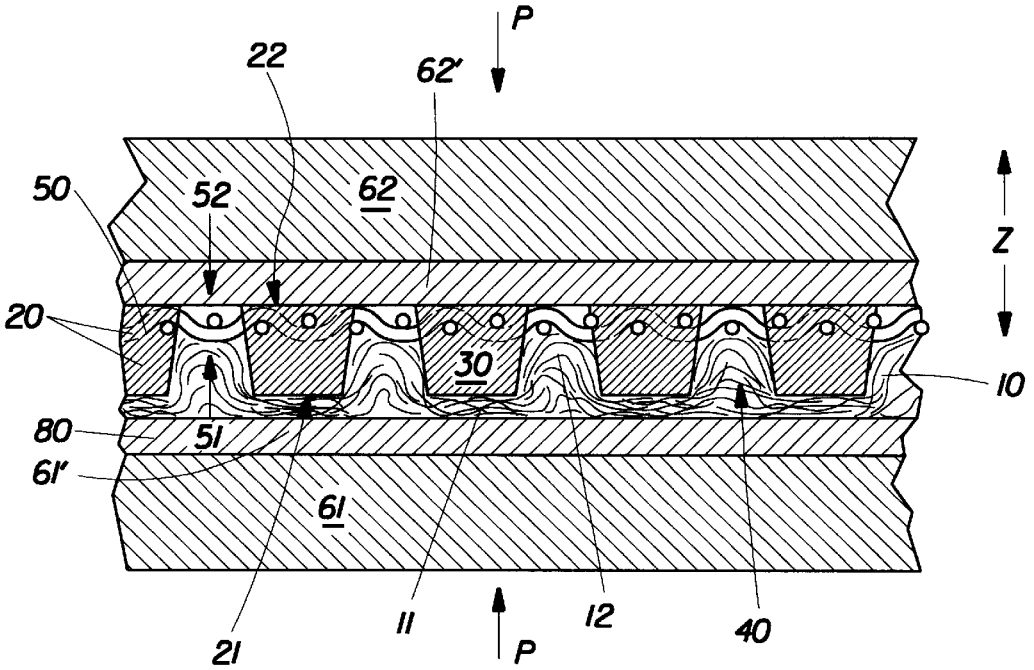
FIG. 2A is a schematic fragmentary cross-sectional view of the papermaking belt taken along lines 2A—2A of FIG. 2, and showing a cellulosic web in association with the papermaking belt being pressurized between a first press member and a second press member.
Figure 3:
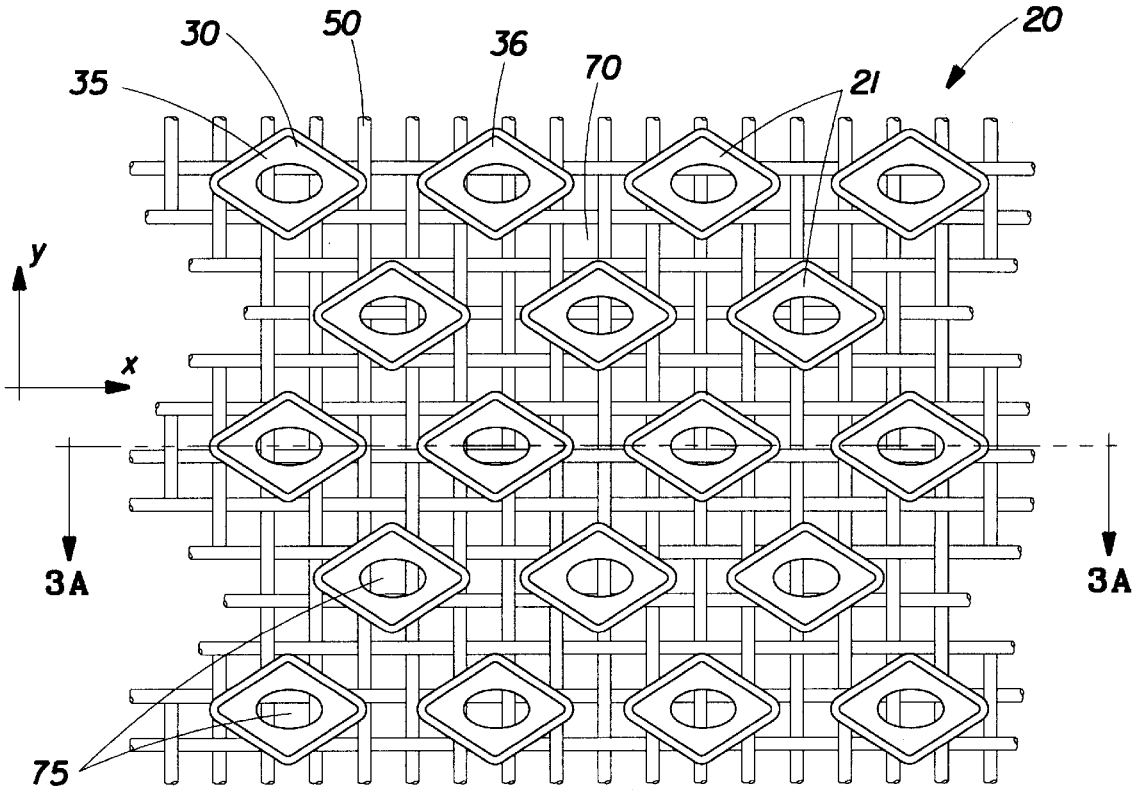
FIG. 3 is a schematic top plan view of the papermaking belt comprising a framework formed by discrete protuberances encompassed by an essentially continuous area of deflection conduits, the discrete protuberances having a plurality of discrete deflection conduits therein.
Figure 3A:
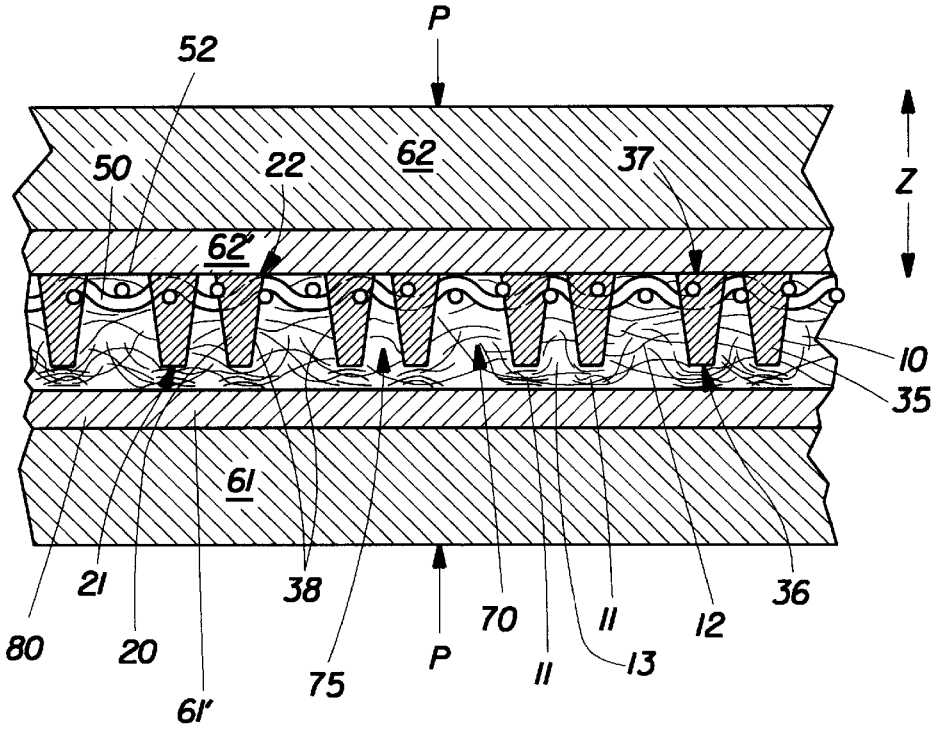
FIG. 3A is a schematic fragmentary cross-sectional view of the papermaking belt taken along lines 3A—3A of FIG. 3 and showing a cellulosic web in association with the papermaking belt being pressurized between a first press member and a second press member.

The next step is applying pressure to the selected portions 11 of the web 10. The step of applying pressure is preferably accomplished by subjecting the web 10 associated with the belt 20 and the belt 20 to a pressure between two mutually opposed press members: a first press member 61 and a second press member 62, as best shown in FIGS. 2A and 3A. The first press member 61 has the first press-surface 61* referred to hereinabove, and the second press member 62 has a second press surface 62*. The first and the second press surfaces 61* and 62* are parallel to the X-Y plane and mutually opposed in the Z-direction. The web 10 and the belt 20 are interposed between the first press surface 61* and the second press surface 62* such that the first press surface 61* contacts the selected portions 11 of the web 10, and the second press surface 62* contacts the backside surface 22 of the belt 20.

The first press member 61 and the second press member 62 are pressed toward each other in the Z-direction (in FIGS. 2A and 3A, the pressure is schematically indicated by the directional arrows P). The first press surface 61* pressurizes the selected portions 11 against the web-facing surface 21 of the belt 20 thereby causing the fibers 100 which are mutually juxtaposed in the selected portions 11 to conform to each other under the pressure P. As a result of the application of the pressure P, a resulting area of contact between the fibers 100 in the selected portions 11 increases, and the softened fiber-binding substance becomes flowable and interconnects the adjacent and mutually juxtaposed fibers 100 in the selected portions 11.

In an alternative embodiment shown in FIGS. 1A and 1B, the step of applying pressure is accomplished at the Yankee drying drum 14. In the latter case, the surface of the Yankee drying drum 14 comprises the first press surface 61*. Under the traditional paper-making conditions, when the web 10 is transferred to the Yankee drying drum 14 using the impression nip roll 29*e* (FIG. 1), the residence time during which the web 10 is under pressure between the surface of the Yankee drum 14 and the impression roll 29*e* is too short to provide full advantage of the application of the pressure and effectively densify the fibers 100 of the selected portions 11, even if the selected portions 11 contains the softened fiber-binding substance. The embodiments shown in FIGS. 1A and 1B allow one to pressurize the web 10 for a much longer period of time and to receive full advantage of the softened and flowable fiber-binding substance.

In FIG. 1A, the web 10 and the molding belt 20*b* are pressurized between the surface of the Yankee dryer drum 14 and a pressing belt 90 having a first side 91 and a second side 92 opposite to the first side 91. The surface of the Yankee drum 14 comprises the first press surface 61* contacting the selected portions 11 of the web 10; and the first side 91 of the pressing belt 90 comprises the second press surface 62* contacting the backside surface 21 of the molding belt 20*b*. The pressing belt 90 is preferably an endless belt schematically shown in FIG. 1A as traveling around return rolls 95*a*, 95*b*, 95*c*, and 95*d* in the direction indicated by the directional arrow D.

FIG. 1B shows a variation of the embodiment shown in FIG. 1A. In FIG. 1B, the web 10 and the molding belt 20*b* are pressurized between the surface of the Yankee drum 14 and a series of pressing rolls 60. Similarly to the embodiment shown in FIG. 1A, in the embodiment shown in FIG. 1B the surface of the Yankee drum 14 is the first press surface 61* contacting the selected portions 11 of the web 10. Surfaces of pressing rolls 60 comprise the second press surface 62* contacting the backside surface 21 of the molding belt 20*b*. Each of the pressing rolls 60 is preferably a resilient roll elastically deformable under the pressure applied towards the surface of the Yankee drying drum 14. Each of the pressing rolls 60 is rotating in the direction indicated by the directional arrow E. Preferably, the pressure at each of the pressing rolls 60 is applied normally to the surface of the Yankee drying drum 14, i. e., towards the center of rotation of the Yankee drying drum 14.

FIG. 1B shows the second press surface 62* comprised of three consecutive pressing rolls 60 applying pressure to the backside surface 21 of the molding belt 20*b*: a first pressing roll 60*a* applying a pressure P1, a second pressing roll 60*b* applying a pressure P2, and a third pressing roll 60*c* applying a pressure P3. The use of a plurality of the pressing rolls 60 allows application of different pressure in discrete stages (FIG. 1B), for example P1<P2<P3, or P1>P2>P3, or any other desirable combination of P1, P2, P3. One skilled in the art will understand that the number of pressing rolls 60 may differ from that shown in FIG. 1B as an illustration of one possible embodiment of the process of the present invention. Similarly to the "zoned" application of the temperature explained above, the use of a plurality of the pressing rolls 60 applying differential pressure in discrete stages enhances flexibility in optimizing the conditions that cause the fiber-binding substance to soften and flow.

The steps of heating and pressurizing the web 10 may be performed concurrently. In the latter case, the first press surface 61* preferably comprises or is associated with a heating element. In FIGS. 2A and 3A, for example, the first press surface 61* comprises the heating wire 80—in accordance with the embodiment of the process shown in FIG. 1. In FIGS. 1A and 1B, the first press surface 61* comprises the heated surface of the Yankee drying drum 14. It is believed that simultaneous pressurizing and heating of the selected portions 11 of the web 10 facilitates softening and flowability of the fiber-binding substance in the selected portions 11.

As has been pointed out above, under the traditional paper-making conditions, when the web 10 is transferred to the Yankee drying drum 14, the residence time during which the web 10 is under pressure between the surface of the Yankee drum 14 and the impressing nip roll 29*e* (FIG. 1) is too short to effectively cause the fiber-binding substance to soften and flow. Although some densification does occur at the transfer of the web 10 to the Yankee dryer's surface at the nip between the surface of the Yankee drum 14 and the surface of the impression nip roll 29*e*, the traditional paper-making conditions do not allow to maintain the web 10 under pressure for more than about 2–5 milliseconds. At the same time, it is believed that for the purposes of causing the softened fiber-binding substance to flow and interconnect the fibers in the selected portions 11, the preferred residence time should be at least about 0.1 second (100 milliseconds).

In contrast with the traditional papermaking process, the embodiments shown in FIGS. 1A and 1B provide a significant increase in the residence time during which the web 10 is subjected to the combination of the temperature and the pressure sufficient to cause the fiber-binding substance to become flowable and interconnect the papermaking fibers in the selected (pressurized) portions 11 of the web 10. According to the process of the present invention, the more preferred residence time is greater than about 1.0 second. The most preferred residence time is in the range of between about 2 seconds and about 10 seconds. One skilled in the art will readily appreciate that at a given velocity of the belt 20, the residence time is directly proportional to the length of a path at which the selected portions 11 of the web 10 are under pressure.

While the selected portions 11 of the web 10 is subjected to the pressure between the first press member 61 and the web-side surface 21 of the belt 20, the rest of the web 10 (designated herein as portions 12) is not subjected to the pressure, thereby retaining the absorbency and softness characteristics of essentially undensified web. To be sure, the first press surface 61* may in some cases contact both the selected portions 11 and the portions 12 of the web 10. Still, even in the latter case, the portions 12 are not subjected to the process of flowing, interconnecting, and immobilization of the fiber-binding substance as the selected portions 11 are.

Prophetically, the preferred exemplary conditions that cause fiber-binding substance to soften and become flowable as to interconnect the adjacent papermaking fibers 100 in the selected portions 11 include heating the first portion 11 of the web 10 having a moisture content of about 30% or greater (i.e., consistency of about 70% or less) to a temperature of at least 70° C. for the period of time of at least 0.5 sec. and preferably under the pressure of at least 1 bar (14.7 PSI). More preferably, the moisture content is at least about 50%, the residence time is at least about 1.0 sec., and the pressure is at least about 5 bar (73.5 PSI). If the web 10 is heated by the first press surface 61*, the preferred temperature of the first press surface 61* is at least about 150° C.

The next step involves immobilization of the flowable fiber-binding substance and creating fiber-bonds between the cellulosic fibers 100 which are interconnected in the selected portions 11 of the web 10. The step of immobilization of the fiber-binding substance may be accomplished by either cooling of the first portion 11 of the web 10, or drying of the first portion 11 of the web 10, or releasing the pressure to which the first portion 11 of the web 10 has been subjected. The three foregoing steps may be performed either in the alternative, or in combination, concurrently or consecutively. For example, in one embodiment of the process, the step of drying alone, or alternatively the step of cooling alone, may be sufficient to immobilize the fiber-binding substance. In another embodiment, for example, the step of cooling may be combined with the step of releasing the pressure. Of course, all three steps may be combined to be performed concurrently, or consecutively in any order. If desired, the resulting web could be creped from the apparatus. A creping blade could be made according to commonly assigned U.S. Pat. No. 4,919,756, issued to Sawdai, which patent is incorporated herein by reference.

Figure 4:
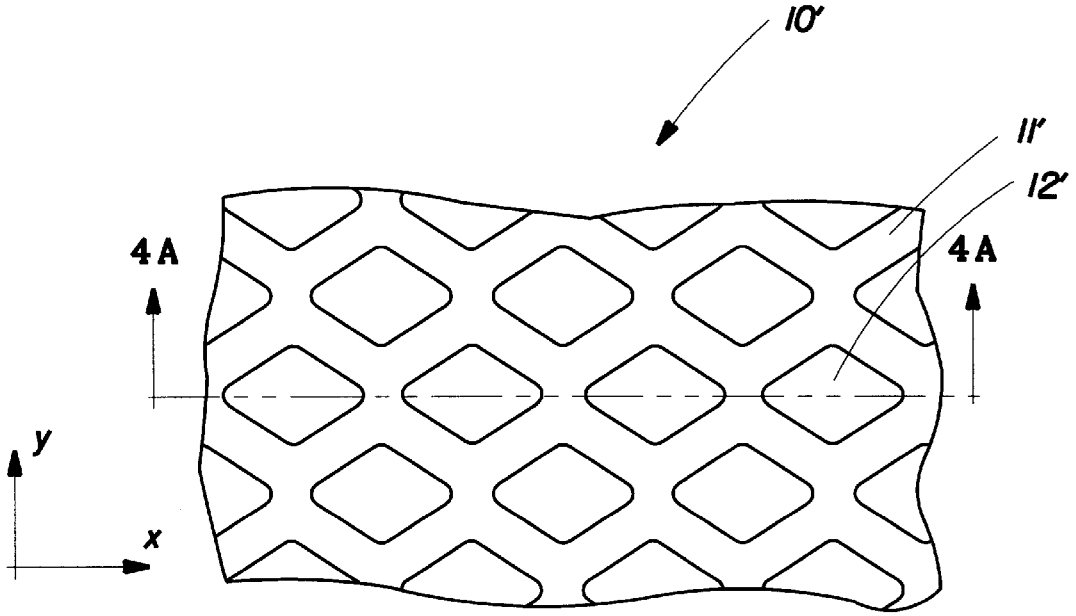
FIG. 4 is a schematic top plan view of a prophetic paper web of the present invention.
Figure 4A:
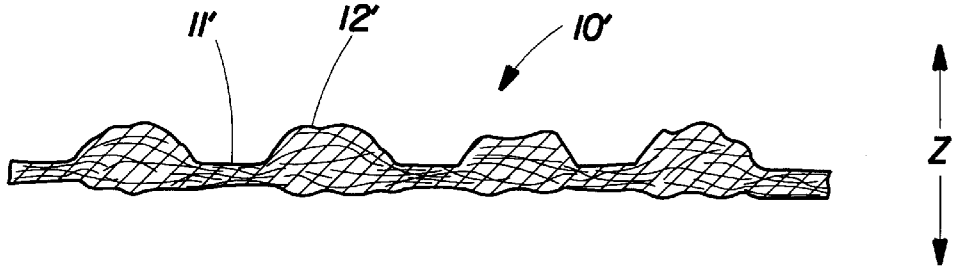
FIG. 4A is a schematic fragmentary cross-sectional view of the paper web taken along lines 4—4 of FIG. 4.

FIGS. 4 and 4A show one prophetic embodiment of the finished fibrous web 10* which is made by the process of the present invention. The web 10* shown in FIGS. 4 and 4A comprises a first plurality of micro-regions 11* and a second plurality of micro-regions 12*. The first plurality of micro-regions 11* is formed by the fibers 100 interconnected with the fiber-binding substance in the selected portions 11 of the web 10. The second plurality of micro-regions is formed by the fibers 100 which are not interconnected with the fiber-binding substance in the rest of the web 10. One skilled in the art will appreciate that in some cases, the same individual fibers 100 may comprise both the first plurality of micro-regions 11* and the second plurality of micro-regions 12*.

One method of determining if the fiber-bonds have been formed is described in an article by Leena Kunnas, et al., "The Effect of Condebelt Drying on the Structure of Fiber Bonds," *TAPPI Journal*, Vol. 76, No. 4, April 1993, which article is incorporated by reference herein and attached hereto as an Appendix.

FIG. 4 shows the first plurality of micro-regions 11* comprising an essentially continuous, macroscopically monoplanar, and patterned network area. This pattern reflects the pattern of the network 66 of the first press surface 61*. The second plurality of micro-regions 12* comprises a plurality of discrete domes, reflecting the pattern of the depressions 67 defined by the network 66 in the first press surface 61*. Essentially all the domes are dispersed throughout, isolated one from another, and encompassed by the network area formed by the first plurality of micro-regions 11*. The domes extend in the Z-direction from the general plane of the network area.

What is claimed is:

1. A process for making a single lamina fibrous web having at least a first plurality of micro-regions formed by fibers interconnected with a fiber-binding substance, and a second plurality of micro-regions, said process comprising the steps of:

(a) providing a fibrous web comprising a fiber-binding substance and water;

(b) providing a macroscopically monoplanar papermaking belt having a web-side surface defining an X-Y plane, a backside surface opposite said web-side surface, and a Z-direction perpendicular to said X-Y plane;

(c) depositing said fibrous web on said web-side surface of said papermaking belt;

(d) heating at least selected portions of said fibrous web thereby causing softening of said fiber-binding substance in said selected portions;

(e) applying pressure to at least said selected portions, thereby causing said fiber-binding substance in said selected portions to flow and interconnect said fibers which are mutually juxtaposed in said selected portions; and (f) immobilizing said fiber-binding substance and creating fiber-bonds between said fibers which are interconnected in said selected portions thereby forming said first plurality of micro-regions from said selected portions of said fibrous web.

2. The process according to claim 1, further comprising the step of depositing said fiber-binding substance to at least said selected portions of said fibrous web, said step being performed prior to the step of heating at least said selected portions of said web.

3. The process according to claim 2, wherein said step of immobilizing said fiber-binding substance and creating said fiber-bonds comprises drying said fibrous web to a consistency of at least about 70% at a temperature less than about 70° C.

4. The process according to claim 1, wherein said step of immobilizing said fiber-binding substance and creating said fiber-bonds in said selected portions comprises drying at least said selected portions of said fibrous web.

5. The process according to claim 1, wherein said step of immobilizing said fiber-binding substance and creating said fiber-bonds in said selected portions comprises cooling at least said selected portions of said fibrous web.

6. The process according to claim 1, wherein said step of immobilizing said fiber-binding substance and creating said fiber-bonds in said selected portions comprises releasing said selected portions of said fibrous web from said pressure.

7. The process according to claim 1, wherein said step of applying pressure to at least said selected portions of said fibrous web comprises pressurizing said fibrous web and said papermaking belt between a first press member and a second press member opposite said first press member, said first and second press members having a first press surface and a second press surface, respectively, said first and second press surfaces being parallel to said X-Y plane and mutually opposed in said Z-direction, said fibrous web and said papermaking belt being interposed between said first and second press surfaces, said first press surface contacting said fibrous web, and said second press surface contacting said backside surface of said papermaking belt, said first and second press members being pressed toward each other in said Z-direction.

8. The process according to claim 7, wherein said first press surface comprises a pressing belt.

9. The process according to claim 7, wherein said first press surface comprises a surface of a Yankee drying drum.

10. The process according to claim 7, wherein said first press surface comprises a macroscopically monoplanar and patterned area.

11. The process according to claim 10 wherein said first press surface comprises an essentially continuous network area.

12. A process for making a single lamina fibrous web comprising fibers and having at least a first plurality of micro-regions comprising said fibers interconnected with a fiber-binding substance in said first plurality of micro-regions, and a second plurality of micro-regions comprising said fibers not interconnected with said fiber-binding substance in said second plurality of micro-regions, said process comprising the steps of:

(a) providing said fibers;

(b) providing a macroscopically monoplanar papermaking belt having a web-side surface defining an X-Y plane, a backside surface opposite said web-side surface, and a Z-direction perpendicular to said X-Y plane;

(c) providing said fiber-binding substance;

(d) depositing said fibers and said fiber-binding substance to said web-side surface of said papermaking belt to form a fibrous web comprising said fiber-binding substance;

(e) heating at least selected portions of said fibrous web to cause softening of said fiber-binding substance in said selected portions;

(f) applying pressure to said selected portions of said fibrous web in said Z-direction, thereby densifying said selected portions of said fibrous web and causing said fiber-binding substance in said selected portions to flow and interconnect said fibers which are mutually juxtaposed in said selected portions; and (g) immobilizing said fiber-binding substance and creating fiber-bonds in said selected portions between said fibers which are interconnected in said selected portions thereby forming said first plurality of micro-regions from said selected portions.

13. The process according to claim 12, wherein said papermaking belt comprises deflection conduits extending between said web-side surface and said backside surface of said papermaking belt, said deflection conduits having web-side openings.

14. The process according to claim 13, further comprising the step of applying a fluid pressure differential to said web such as to leave said first portion of said fibrous web on said web-side surface of said belt while deflecting said second portion of said fibrous web into said deflection conduits, said step of applying a fluid pressure differential to said web being performed prior to the step of heating.

15. The process according to claim 14, wherein said papermaking belt comprises a fluid-permeable reinforcing structure joined to a framework having a first side and a second side opposite said first side, said reinforcing structure positioned therebetween, said first and second sides of said framework defining said web-side and backside surfaces of said papermaking belt, respectively.

16. The process according to claim 15 wherein said web-side surface of said papermaking belt comprises an essentially continuous web-side network, said web-side network defining web-side openings of said deflection conduits.

17. The process according to claims 1, 12, wherein said fiber-binding substance is selected from the group consisting of hemicelluloses, lignin, polymeric extractives, or any combination thereof.

* * * * *

UNITED STATES PATENT AND TRADEMARK OFFICE

CERTIFICATE OF CORRECTION

PATENT NO. : 5,938,893

DATED : August 17, 1999

INVENTOR(S) : Paul Dennis Trokhan et al.

It is certified that error appears in the above-identified patent and that said Letters Patent is hereby corrected as shown below:

On title page,

Please add the following references under U.S. PATENT DOCUMENTS:

| | | | |
|---|---|---|---|
| -- 5,549,790 | 8/1996 | Van Phan | 162/109 |
| 5,814,190 | 9/1998 | Van Phan | 162/111 -- |

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*